US011454000B2

(12) United States Patent
Lucas et al.

(10) Patent No.: US 11,454,000 B2
(45) Date of Patent: Sep. 27, 2022

(54) SYSTEM AND METHOD FOR DEPOSITING MATERIAL AT A TARGET LOCATION WITH A WORK VEHICLE

(71) Applicant: CNH Industrial America LLC, New Holland, PA (US)

(72) Inventors: Natalia Lucas, Mundelein, IL (US); Stojan Arezina, Willowbrook, IL (US); Brad Anthony Stemper, Racine, WI (US); Andrea Maria Cardona Alfaro, Skokie, IL (US); Wei Liu, Chicago, IL (US)

(73) Assignee: CNH Industrial America LLC, New Holland, PA (US)

( * ) Notice: Subject to any disclaimer, the term of this patent is extended or adjusted under 35 U.S.C. 154(b) by 29 days.

(21) Appl. No.: 16/813,292

(22) Filed: Mar. 9, 2020

(65) Prior Publication Data

US 2021/0277627 A1 Sep. 9, 2021

(51) Int. Cl.

| | |
|---|---|
| ***E02F 9/20*** | (2006.01) |
| ***E02F 9/26*** | (2006.01) |
| ***E02F 3/43*** | (2006.01) |
| ***E02F 3/28*** | (2006.01) |

(52) U.S. Cl.

CPC ..... *E02F 9/205* (2013.01); *E02F 3/431* (2013.01); *E02F 9/2037* (2013.01); *E02F 9/26* (2013.01); *E02F 3/283* (2013.01)

(58) Field of Classification Search

CPC . E02F 3/283; E02F 3/431; E02F 3/434; E02F 9/2037; E02F 9/205; E02F 9/26; E02F 9/261; E02F 9/265

See application file for complete search history.

(56) References Cited

U.S. PATENT DOCUMENTS

| | | | | | |
|---|---|---|---|---|---|
| 4,230,196 | A * | 10/1980 | Snead | E02F 3/3411 | 177/141 |
| 4,921,578 | A * | 5/1990 | Shiraishi | G01G 19/08 | 177/136 |
| 5,220,968 | A * | 6/1993 | Weber | G01G 19/08 | 177/139 |
| 5,560,551 | A * | 10/1996 | Suverkrop | B02C 21/02 | 241/101.74 |

(Continued)

*Primary Examiner* — Tyler J Lee

(74) *Attorney, Agent, or Firm* — Rebecca L. Henkel; Rickard K. DeMille

(57) ABSTRACT

A method for depositing material at a target location with a work vehicle includes receiving an input associated with a target weight of the material to be deposited at the target location. Additionally, the method includes controlling an operation of the vehicle such that an implement of the vehicle obtains a quantity of the material. Furthermore, the method includes controlling the operation of the vehicle such that the implement is raised from a first to a second position. Moreover, the method includes determining a weight of the currently obtained quantity of the material as the implement is raised from the first to the second position. In addition, the method includes controlling the operation of the vehicle such that the currently obtained quantity of the material is deposited at the target location. Further, the method includes initiating display of a current total weight of the material deposited at the target location.

14 Claims, 6 Drawing Sheets

(56) References Cited

U.S. PATENT DOCUMENTS

| | | | | | |
|---|---|---|---|---|---|
| 5,848,368 | A * | 12/1998 | Allen | G07C 5/008 | 701/50 |
| 6,211,471 | B1 * | 4/2001 | Rocke | G01G 19/083 | 177/136 |
| 6,246,939 | B1 * | 6/2001 | Nozawa | E02F 9/2228 | 701/50 |
| 6,321,153 | B1 * | 11/2001 | Rocke | E02F 3/434 | 172/4.5 |
| 6,931,772 | B2 * | 8/2005 | Furuno | G01G 19/08 | 37/348 |
| 7,555,855 | B2 * | 7/2009 | Alshaer | E02F 3/434 | 37/382 |
| 7,627,410 | B2 * | 12/2009 | Berry | E02F 9/2029 | 701/1 |
| 8,340,872 | B2 * | 12/2012 | Mintah | E02F 9/264 | 701/50 |
| 8,954,243 | B2 * | 2/2015 | Harshberger | G01G 19/10 | 701/50 |
| 9,695,571 | B1 * | 7/2017 | Ge | G01G 19/08 | |
| 2004/0117092 | A1 * | 6/2004 | Budde | E02F 3/432 | 701/50 |
| 2007/0135985 | A1 * | 6/2007 | Berry | E02F 9/2029 | 701/50 |
| 2007/0260380 | A1 * | 11/2007 | Mintah | E02F 9/264 | 701/50 |
| 2014/0336874 | A1 * | 11/2014 | Harshberger, II | G01G 19/10 | 701/36 |
| 2017/0191245 | A1 * | 7/2017 | Shatters | E02F 3/283 | |

* cited by examiner

SYSTEM AND METHOD FOR DEPOSITING MATERIAL AT A TARGET LOCATION WITH A WORK VEHICLE

FIELD OF THE INVENTION

The present disclosure generally relates to work vehicles and, more particularly, to a system and method for depositing material, such as sand, gravel, and the like, at a target location with a work vehicle.

BACKGROUND OF THE INVENTION

Work vehicles having loader arms or booms, such as wheel loaders, skid steer loaders, and the like, are a mainstay of construction work and industry. For example, wheel loaders typically include a boom pivotably coupled to the vehicle's chassis that can be raised and lowered at the operator's command. The boom typically has an implement attached to its end, thereby allowing the implement to be moved relative to the ground as the boom is raised and lowered. For example, a bucket is often coupled to the boom, which allows the wheel loader to be used to carry supplies or particulate material, such as gravel, sand, or dirt, around a worksite or to transfer such supplies or material to an adjacent transport vehicle (e.g., a truck or railroad car).

When using a work vehicle to load material into a transport vehicle, it is often desirable to have an accurate estimate of the total weight of the material deposited into the transport vehicle. For instance, weight estimates may be used to determine how much material has been loaded onto the transport vehicle to ensure that its load capacity is not exceeded. In this regard, several systems have been developed that attempt to estimate the total weight of the material deposited into the vehicle. However, to date, such systems lack the accuracy and/or reliability typically desired by operators of commercial work vehicles.

Accordingly, an improved system and method for depositing material at a target location with a work vehicle would be welcomed in the technology.

SUMMARY OF THE INVENTION

Aspects and advantages of the technology will be set forth in part in the following description, or may be obvious from the description, or may be learned through practice of the technology.

In one aspect, the present subject matter is directed to a method for depositing material at a target location with a work vehicle. The method includes receiving, with one or more computing devices, an input associated with a target weight of the material to be deposited at the target location. Additionally, the method includes controlling, with the one or more computing devices, an operation of the work vehicle such that an implement of the work vehicle obtains a quantity of the material. Furthermore, the method includes controlling, with the one or more computing devices, the operation of the work vehicle such that the implement is raised from a first position to a second position. Moreover, the method includes determining, with the one or more computing devices, a weight of the currently obtained quantity of the material as the implement is raised from the first position to the second position. In addition, the method includes controlling, with the one or more computing devices, the operation of the work vehicle such that the currently obtained quantity of the material is deposited at the target location. Further, the method includes initiating, with the one or more computing devices, display of a current total weight of the material deposited at the target location.

In another aspect, the present subject matter is directed to a system for depositing material at the target location with a work vehicle. The system includes a lift assembly including a boom and an implement coupled to the boom, a display device, and a controller communicatively coupled to the display device. The controller is, in turn, configured to control an operation of the work vehicle. As such, the controller includes a processor and associated memory, with the memory storing instructions that, when implemented by the processor, configure the controller to receive an input associated with a target weight of the material to be loaded at the target location. Additionally, the controller is configured to control the operation of the work vehicle such that the implement obtains a quantity of the material. Furthermore, the controller is configured to control the operation of the work vehicle such that the implement is raised from a first position to a second position. Moreover, the controller is configured to determine a weight of the currently obtained quantity of the material as the implement is raised from the first position to the second position. In addition, the controller is configured to control the operation of the work vehicle such that the currently obtained quantity of the material is deposited at the target location. Further, the controller is configured to initiate display of a current total weight of the material deposited at the target location on the display device.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
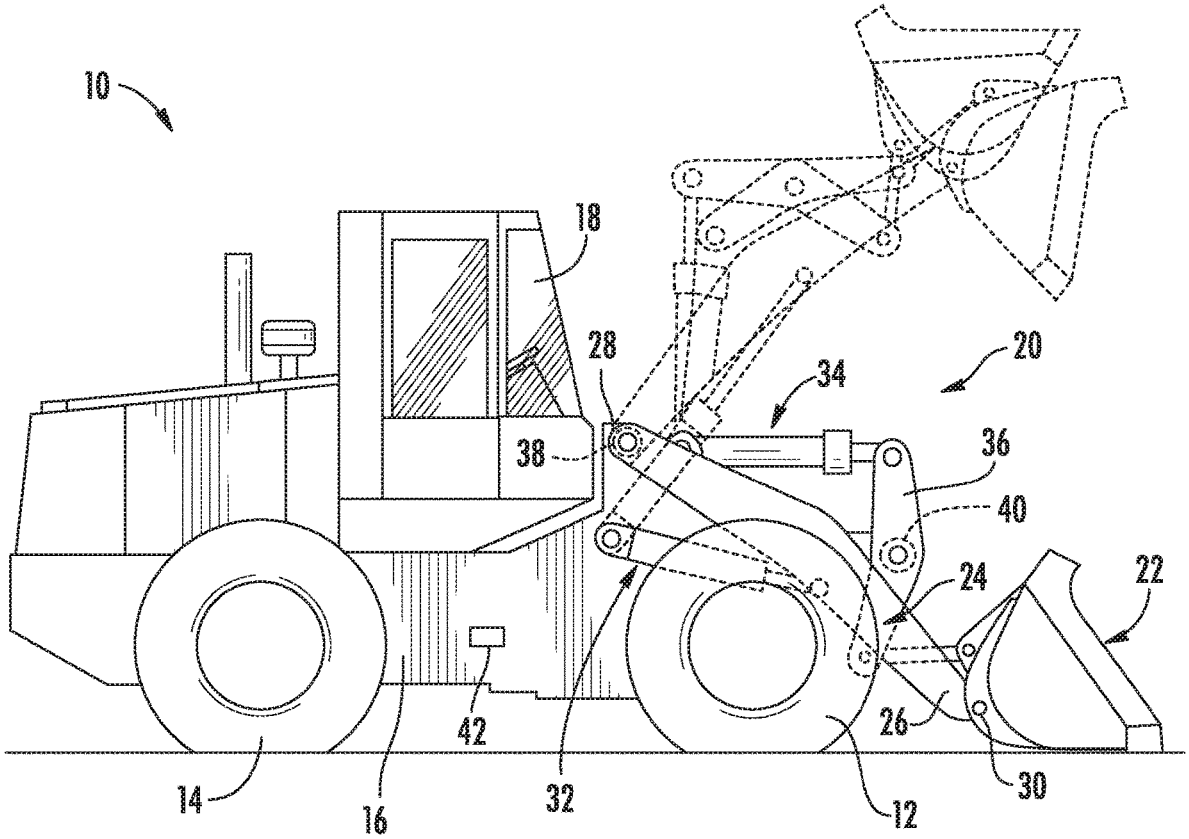
FIG. 1 illustrates a side view of one embodiment of a work vehicle in accordance with aspects of the present subject matter.

Repeat use of reference characters in the present specification and drawings is intended to represent the same or analogous features or elements of the present technology.

DETAILED DESCRIPTION OF THE DRAWINGS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a system and method for depositing material at the target location with a work vehicle. As will be described below, the present subject matter may be used with a wheel loader or any other work vehicle that includes a lift assembly having a boom and an implement (e.g., a bucket) coupled to the boom. As such, the lift assembly may be operable to transfer a material (e.g., sand, gravel, dirt, and/or the like) from a material pile or source to a target location, such as a truck or a railroad car.

In several embodiments, a controller of the disclosed system may be configured to control the operation of the work vehicle such that the material is deposited at the target location. More specifically, the controller may be configured to receive an input associated with a target weight of the material to be deposited at the target location from an operator of the vehicle. In this respect, the controller may be configured to control the operation of the work vehicle such that the implement obtains a quantity (e.g., a bucket load) of the material from the pile. Moreover, the controller may be configured to control the operation of the vehicle such that the implement is raised from a first or lowered position to a second or raised position. As the implement is moved from the first position to the second position, the controller may be configured to determine the weight of the currently obtained quantity of the material. Thereafter, the controller may be configured to control the operation of the work vehicle such that the currently obtained quantity of the material is deposited at the target location.

In accordance with aspects of the present subject matter, the controller may be configured to initiate display of the current total weight of the material deposited at the target location on a display device of the vehicle. In many instances, the weight of the material that can be obtained by the implement at one time is generally less than the target weight of the material to be deposited at the target location. In such instances, the controller may be configured to control the operation of the vehicle such that several quantities (e.g., bucket loads) of the material are successively deposited at the target location. In this respect, as each quantity (e.g., bucket load) is deposited at the target location, the controller may be configured to determine the current total weight of the material that has been deposited at the target location. Thereafter, the controller may be configured to initiate display the determined current total weight on the display device and, subsequently, update the displayed weight as additional quantities of the material are deposited.

Referring now to the drawings, FIG. 1 illustrates a side view of one embodiment of a work vehicle 10 in accordance with aspects of the present subject matter. As shown, the work vehicle 10 is configured as a wheel loader. However, in other embodiments, the work vehicle 10 may be configured as any other suitable work vehicle that includes a lift assembly for adjusting the position of an associated implement, such as a skid steer loader, a backhoe loader, a compact track loader and/or the like.

As shown, the work vehicle 10 includes a pair of front wheels 12, (one of which is shown), a pair of rear wheels 14 (one of which is shown), and a frame or chassis 16 coupled to and supported by the wheels 12, 14. An operator's cab 18 may be supported by a portion of the chassis 16 and may house various input devices for permitting an operator to control the operation of the work vehicle 10.

Moreover, as shown in FIG. 1, the work vehicle 10 may include a lift assembly 20 for raising and lowering a suitable implement 22 (e.g., a bucket) relative to a driving surface of the vehicle 10. In several embodiments, the lift assembly 20 may include a boom 24 (e.g., including one or more loader or boom arms) pivotably coupled between the chassis 16 and the implement 22. For example, as shown in FIG. 1, the boom 24 may include a forward end 26 and an aft end 28, with the forward end 26 pivotably coupled to the implement 22 at a forward pivot point 30 and the aft end 28 pivotally coupled to a portion of the chassis 16.

In addition, the lift assembly 20 may also include one or more boom cylinders 32 coupled between the chassis 16 and the boom 24 and one or more tilt cylinders 34 coupled between the chassis 16 and the implement 22 (e.g., via a pivotably mounted bell crank 36 or other mechanical linkage). In this respect, the boom and tilt cylinders 32, 34 may raise/lower and/or pivot the implement 22 relative to the driving surface of the work vehicle 10. Specifically, the boom cylinder(s) 32 may be extended and retracted to pivot the boom 24 upward and downward, respectively, thereby at least partially controlling the vertical positioning of the implement 22 relative to the driving surface. For instance, as shown in FIG. 1, the operation of the boom cylinder(s) 32 may be controlled to move the boom 24 between a lowered position (indicated in solid lines), such as a return-to-dig-position or a return-to-travel position, and a raised position (indicated in dashed lines), such as a return-to-height position or a return-to-dump position. Additionally, the tilt cylinder(s) 34 may be extended and retracted to pivot the implement 22 relative to the boom 24 about the forward pivot point 30, thereby controlling the tilt angle or orientation of the implement 22 relative to the driving surface. For instance, the operation of the tilt cylinder(s) 34 may be controlled to tilt the implement 22 between a roll-back position at which material is retained within the implement 22 and maximum dump position at which all the material is dumped from the implement 22. Moreover, the implement 22 may be tilted at one or more partial dump positions between the roll-back position and the maximum dump position. As will be described below, a portion of the material present within the implement 22 may be dumped off (also known as tipped off) the implement 22 to reduce the amount of material present within the implement 22.

The work vehicle 10 may also include a plurality of sensors for monitoring for various operating parameters of the work vehicle 10. Specifically, in several embodiments, the work vehicle 10 may include one or more position sensors 38, 40 for monitoring the position and/or orientation of the boom 24 and/or the implement 22. For instance, as shown in FIG. 1, the work vehicle 10 includes a first position sensor 38 provided in operative association with the boom 24 (e.g., at or adjacent to the aft end 28 of the boom 24) and a second position sensor 40 provided in operative association with the bell crank 36 (e.g., at or adjacent to a pivot point for the bell crank 36). The position sensors 38, 40 may also allow the velocity of the boom 24 and/or the implement 22 to be determined by identifying the change in position of such component(s) over time. Additionally, the work vehicle 10 may include one or more inclination sensors 42 configured to monitor the angle of inclination of the work vehicle 10. For example, in one embodiment, the work vehicle 10 may include a dual-axis inclination sensor 42 mounted to the chassis 16 that is configured to monitor the angle of inclination of the work vehicle 10 in both a pitch direction (e.g., the front-to-back inclination) and a roll direction (e.g., the side-to-side inclination). Moreover, as will be described below, the work vehicle 10 may also include one or more pressure sensors 44, 46, 48, 50 (FIG. 2) for monitoring the pressure of the hydraulic fluid supplied to the boom cylinder(s) 32 and/or the tilt cylinder(s) 34 and/or one or more temperature sensors 52 (FIG. 2) for monitoring the fluid temperature of the hydraulic fluid.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration.

Figure 2:
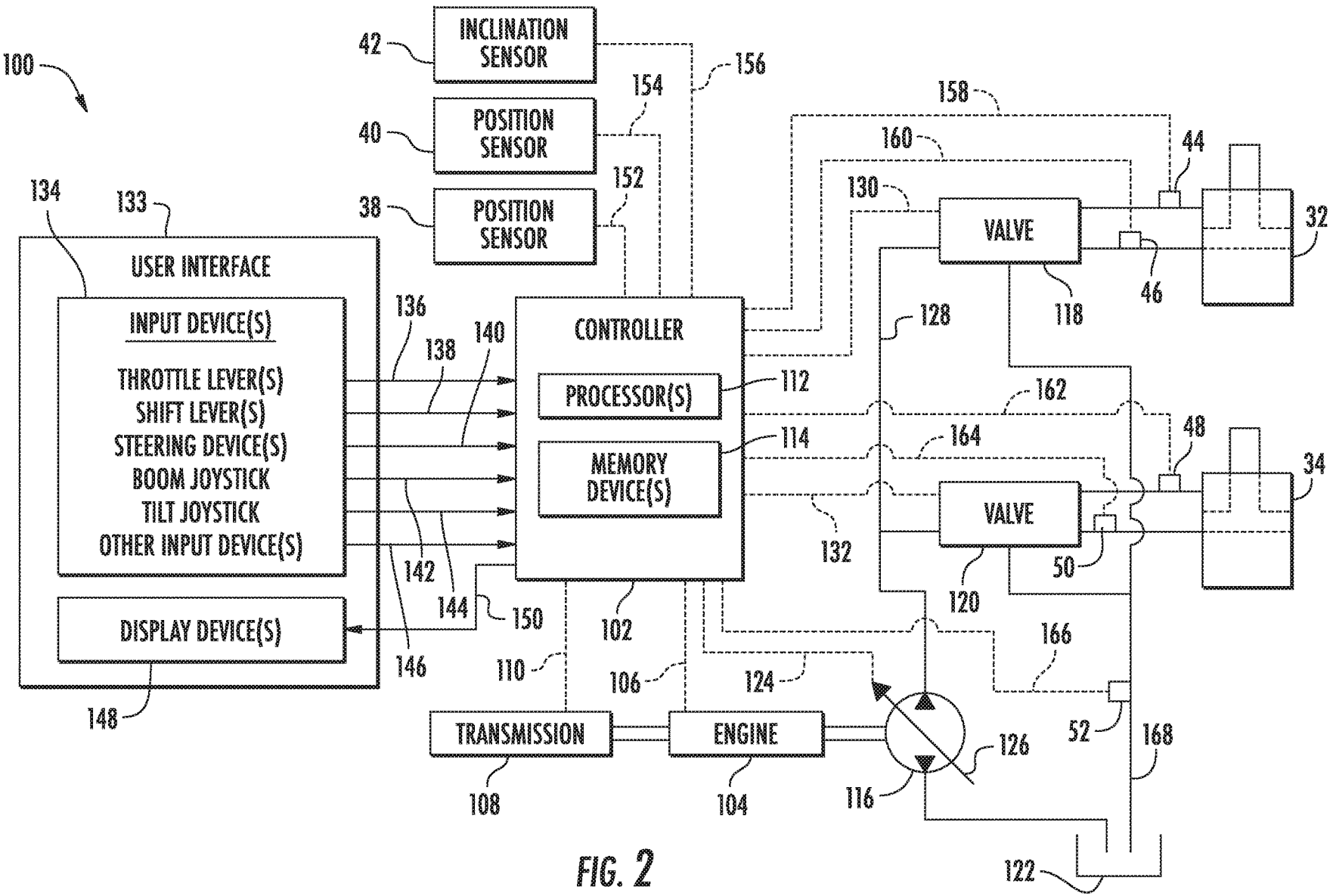
FIG. 2 illustrates a schematic view of one embodiment of a system for depositing material at a target location with a work vehicle in accordance with aspects of the present subject matter.

Referring now to FIG. 2, a schematic view of one embodiment of a system 100 for depositing material at a target location with a work vehicle is illustrated in accordance with aspects of the present subject matter. In general, the system 100 will be described herein with reference to the work vehicle 10 shown in FIG. 1. However, the disclosed system 100 may be used with any other suitable work vehicles able to deposit material at a target location. The hydraulic or fluid couplings of the system 100 shown in FIG. 2 are indicated by solid lines. Similarly, communicative links or electrical couplings of the system 100 shown in FIG. 2 are indicated by dashed lines.

As shown in FIG. 2, in several embodiments, the system 100 may include a controller 102 configured to control the operation of one or more components of the work vehicle 10, such as one or more components of the vehicle's drivetrain and/or the vehicle's lift assembly 20. For example, the controller 102 may be communicatively coupled to one or more components of an engine 104 of the work vehicle 10 (e.g., an engine governor or engine control unit (ECU) (not shown)) via one or more communicative links 106 in order to control and/or monitor the speed and/or torque output of the engine 104. Similarly, the controller 102 may be communicatively coupled to one or more components of a transmission 108 of the work vehicle 10 via one or more communicative links 110 to control the operation of the transmission 108. For instance, the controller 102 may be configured to transmit suitable control commands via one or more communicative links 110 to one or more clutch valves (not shown) to control the engagement/disengagement of one or more clutches (not shown) of the transmission 108.

The controller 102 may generally comprise any suitable processor-based device known in the art, such as one or more computing devices. Thus, in several embodiments, the controller 102 may include one or more processor(s) 112 and associated memory device(s) 114 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory 114 of the controller 102 may generally comprise memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory 114 may generally be configured to store suitable computer-readable instructions that, when implemented by the processor(s) 112, configure the controller 102 to perform various computer-implemented functions, such as performing the various calculations and/or algorithms described herein (including implementing the flow diagrams described below with reference to FIGS. 3-6). In addition, the controller 102 may also include various other suitable components, such as a communications circuit or module, one or more input/output channels, a data/control bus and/or the like.

The controller 102 may correspond to an existing controller of the work vehicle 10 (e.g., an existing engine and/or transmission controller) or the controller 102 may correspond to a separate controller. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

Moreover, the controller 102 may also be communicatively coupled to one or more components for controlling the operation of the various cylinders 32, 34 of the lift assembly 20 of the work vehicle 10. For example, in several embodiments, the controller 102 may be communicatively coupled to one or more hydraulic pumps 116 and associated control valves 118, 120 for controlling the flow of hydraulic fluid from a fluid tank 122 of the work vehicle 10 to each cylinder 32, 34. Specifically, as shown in FIG. 2, the pump(s) 116 is driven via the output of the engine 104. In such an embodiment, the controller 102 may be communicatively coupled to the pump(s) 116 (e.g., via a communicative link(s) 124) such that the position or angle of a swash plate of the pump(s) 116 (the swash plate being denoted by diagonal arrow 126 through the illustrated pump 116) may be automatically adjusted to regulate the discharge pressure of the pump(s) 116. In one embodiment, the angle of the swash plate 126 may be adjusted via an associated actuator(s) (not shown) configured to be controlled by the controller 102.

Additionally, the hydraulic pump(s) 116 may be fluidly coupled to one or more boom control valves 118 and one or more tilt control valves 120 via one or more fluid lines 128. The boom control valve(s) 118 may generally be configured to regulate the supply of hydraulic fluid to the boom cylinder(s) 32, thereby controlling the extension/retraction of the boom cylinder(s) 32. Similarly, the tilt control valve(s) 120 may generally be configured to regulate the supply of hydraulic fluid to the tilt cylinder(s) 34, thereby controlling the extension/retraction of the tilt cylinder(s) 34. In several embodiments, the control valves 118, 120 may correspond to electrically controlled valves (e.g., solenoid-activated valves) to allow the controller 102 to automatically control the operation of each valve 118, 120. For instance, as shown in FIG. 2, the controller 102 is communicatively coupled to the control valves 118, 120 via associated communicative links 130, 132, thereby allowing the controller 102 to regulate the extension/retraction of the associated cylinders 32, 34 via control of the valves 118, 120.

The controller 102 may also be communicatively coupled to a user interface 133 located within the vehicle's cab 18. Specifically, in several embodiments, the user interface 133 may include one or more operator-controlled input devices 134. In such embodiments, the controller 102 may be configured to receive various operator-initiated control commands for controlling the operation of the work vehicle 10. For instance, the controller 102 may be communicatively coupled to an engine throttle lever to allow the controller 102 to receive control signals associated with operator-initiated engine speed commands for adjusting the engine speed of the engine 104 (e.g., as indicated by arrow 136 in FIG. 2). In addition, the controller 102 may be communicatively coupled to a shift lever or other suitable input device configured to allow the operator to transmit control signals associated with operator-initiated shift commands for adjusting the current gear ratio of the transmission 108 (e.g., as indicated by arrow 138 in FIG. 2). Similarly, the controller 102 may be communicatively coupled to a steering sensor configured to allow the controller 102 to receive steering commands (e.g., as indicated by arrow 140 in FIG. 2) associated with adjustments in the vehicle's steering angle as the operator manipulates the steering wheel or other steering device of the work vehicle 10. Moreover, the controller 102 may be communicatively coupled to one or more joysticks for receiving control commands associated with controlling the movement of the boom 32 and/or the implement 34. For instance, the controller 102 may be communicatively coupled to both a boom joystick for receiving operator-initiated control commands associated with controlling the movement of the boom 24 (e.g., as indicated by arrow 142 in FIG. 2) and a tilt joystick for receiving operator-initiated control commands associated with controlling the movement of the implement 22 (e.g., as indicated by arrow 144 in FIG. 2).

Furthermore, the user interface 133 may include one or more additional input devices, such as one or more buttons, knobs, touch pads, and/or other user interface elements, that allow the operator to provide inputs (e.g., as indicated by arrow 146 in FIG. 2) requesting that the controller 102 perform or initiate an automated boom and/or tilt movement operation. For instance, one or more predefined boom/implement positions may be stored within the controller's memory 114, such as a return-to-height position, a return-to-dump position, a return-to-travel position, a return-to-dig position, and/or the like. In such an embodiment, the operator may use an appropriate input device(s) to provide an operator input associated with the selection of one or more predefined boom/implement positions. Upon receipt of the input, the controller 102 may be configured to automatically control the operation of the control valves 118, 120 to regulate the extension and/or retraction of the associated cylinders 32, 34 of the vehicle's hydraulic system such that the boom/implement 24, 22 is automatically moved to the operator-selected position.

Additionally, the user interface 133 may include one or more display screens or devices 148. Specifically, in several embodiments, the controller 102 may be communicatively coupled to display device(s) 148 configured to allow the controller 102 to transmit instructions (e.g., as indicated by arrow 150 in FIG. 2) to the display device(s) 148. Upon receipt of the instructions 150, the display device(s) 148 may display one or more interface elements (e.g., numbers, bars, and/or the like) associated with the weight of the material currently obtained by the implement 22 and/or the current total weight of the material deposited at a target location by the implement 22.

As indicated above, the controller 102 may also be communicatively coupled to one or more position sensors 38, 40 (e.g., via communicative links 152, 154) for monitoring the position(s) and/or orientation(s) of the boom 24 and/or the implement 22. In several embodiments, the position sensor(s) 38, 40 may correspond to one or more angle sensors (e.g., a rotary or shaft encoder(s) or any other suitable angle transducer(s)) configured to monitor the angle or orientation of the boom 24 and/or implement 22 relative to one or more reference points. For instance, in one embodiment, a first angle sensor(s) may be positioned at the rear pivot point for the boom 24 to allow the angular position of the boom 24 relative to the work vehicle 10 to be monitored. Similarly, in one embodiment, a second angle sensor(s) may be positioned at one of the pivot points for the bell crank 36 to allow the position of the implement 22 relative to the boom 24 to be monitored. In alternative embodiments, the position sensors 38, 40 may correspond to any other suitable sensor(s) configured to provide a measurement signal or other data associated with the position and/or orientation of the boom 24 and/or the implement 22, such as one or more inclinometers, inertial measurement units, cylinder length sensors, and/or the like. The position sensors 38, 40 may also allow the movement velocity of the boom 24 and/or the implement 22 to be determined by identifying the change in position of such component(s) over time.

Moreover, as indicated above, the controller 102 may also be communicatively coupled to one or more inclination sensors 42 (e.g., via a communicative link 156) configured to monitor the angle of inclination of the work vehicle 10. For example, in several embodiments, the inclination sensor(s) 42 may correspond to one or more one or more accelerometers, inclinometers, gyroscopes and/or any other suitable inclination sensor(s) configured to monitor the angle of inclination of the work vehicle 10 by measuring its orientation relative to gravity. For instance, as described above with reference to FIG. 1, the inclination sensor(s) 42 may correspond to a dual-axis sensor mounted to a portion of the chassis 16 to allow the sensor(s) 42 to monitor the angle of inclination of the work vehicle 10 in two directions (e.g., the pitch and roll directions of the work vehicle 10). However, in other embodiments, the inclination sensor(s) 42 may be disposed on the work vehicle 10 at any other suitable location.

Additionally, in several embodiments, the system 100 may also include one or more pressure sensors 44, 46, 48, 50 communicatively coupled to the controller 102 (e.g., via communicative links 158, 160, 162, 164) to allow the controller 102 to monitor the fluid pressure of the hydraulic fluid being supplied to the boom cylinder(s) 32 and/or the tilt cylinder(s) 34. For example, the controller 102 may be coupled to first and second pressure sensors 44, 46 provided in fluid communication with the fluid lines provided between the boom control valve(s) 118 and the boom cylinder(s) 32. As such, the first pressure sensor 44 may be configured to monitor the fluid pressure of the hydraulic fluid supplied to the rod-side of the boom cylinder(s) 32. Similarly, the second pressure sensor 46 may be configured to monitor the fluid pressure of the hydraulic fluid supplied to the piston-side of the boom cylinder(s) 32. Additionally, the controller 102 may be coupled to third and fourth pressure sensors 48, 50 provided in fluid communication with the fluid lines provided between the tilt control valve(s)

120 and the tilt cylinder(s) 34. In this respect, the third pressure sensor 48 may be configured to monitor the fluid pressure of the hydraulic fluid supplied to the rod-side of the tilt cylinder(s) 34. Similarly, the fourth pressure sensor 50 may be configured to monitor the fluid pressure of the hydraulic fluid supplied to the piston-side of the tilt cylinder(s) 34.

Referring still to FIG. 2, the controller 102 may also be communicatively coupled to one or more temperature sensors 52 (e.g., via a communicative link 166) configured to allow the temperature of the hydraulic fluid used within the vehicle's hydraulic system to be monitored. For instance, as shown in FIG. 2, the temperature sensor(s) 52 is, in one embodiment, be provided in operative association with a return line 168 for the hydraulic fluid to allow the fluid temperature of the hydraulic fluid being returned to the fluid tank 122 to be monitored.

The controller 102 may also be communicatively coupled to any other suitable sensors configured to monitor one or more operating parameters of the work vehicle 10 and/or its components. For instance, the controller 102 may also be communicatively coupled to a suitable sensor(s) (not shown) that allows the controller 102 to monitor the speed and/or acceleration of the work vehicle 10.

As indicated above, the disclosed system 100 may be used to determine or estimate the current load weight being carried by the vehicle's implement 22. More specifically, the controller 102 may include known mathematical relationships and/or look-up tables stored within its memory 114 that correlate the vehicle's boom geometry and various relevant operating parameters (e.g., the angular position of the boom 24, the angular position of the implement 22, the velocity of the boom 24 and/or the implement 22, the angle of inclination of the work vehicle 10, the boom cylinder pressure(s), the tilt cylinder pressure(s), the temperature of the hydraulic fluid, and/or the speed and/or acceleration of the work vehicle 10) to an associated load weight of the implement 22. Thus, by continuously monitoring the relevant operating parameters using the various sensors described above (e.g., the position sensors 38, 40; the inclination sensors 42; the pressure sensors 44, 46, 48, 50; the temperature sensors 52; and/or the like), the controller 102 may calculate a current load weight for the implement 22 based on such load-related data. This estimated load weight may then be displayed to the operator of the work vehicle 10 via the display device(s) 148.

In several embodiments, the controller 102 may be configured to determine the load weight for the implement 22 as the boom 24 is being moved across a range of angular boom positions. For instance, as indicated above, the controller 102 may be configured to control the operation of the boom control valve(s) 118 to move the boom 24 across a range of positions from a lowered position relative to the driving surface to a raised position relative to the driving surface. During such boom movement, the controller 102 may be configured to monitor the load-related data received from the various sensors 38, 40, 42, 44, 46, 52 to determine the load weight associated with the implement 22.

Furthermore, in several embodiments, the controller 102 may be configured to estimate the load weight for the implement 22 as the implement 22 is moved from a partial dump position to a roll-back position. In general, as mentioned above, the partial dump position may correspond to a tilt of the implement 22 at which a portion of the material present within the implement 22 may be dispensed from the implement 22. For instance, as indicated above, the controller 102 may be configured to control the operation of the tilt control valve(s) 120 move the implement 22 from the partial dump position to the roll-back position. During such implement movement, the controller 102 may be configured to monitor the load-related data received from the various sensors 38, 40, 42, 48, 50, 52 to estimate the load weight associated with the implement 22. As will be described below, the load weight determined while the boom 24 is moved between the first and the second positions may generally be more accurate than the load weight estimated while the implement 22 is moved from the dump position to the roll-back position. However, the determination of the load weight while the boom 24 is moved between the first and the second positions may generally be more time consuming than the estimation of the load weight while the implement 22 is moved from the partial dump position to the roll-back position.

Figure 3:
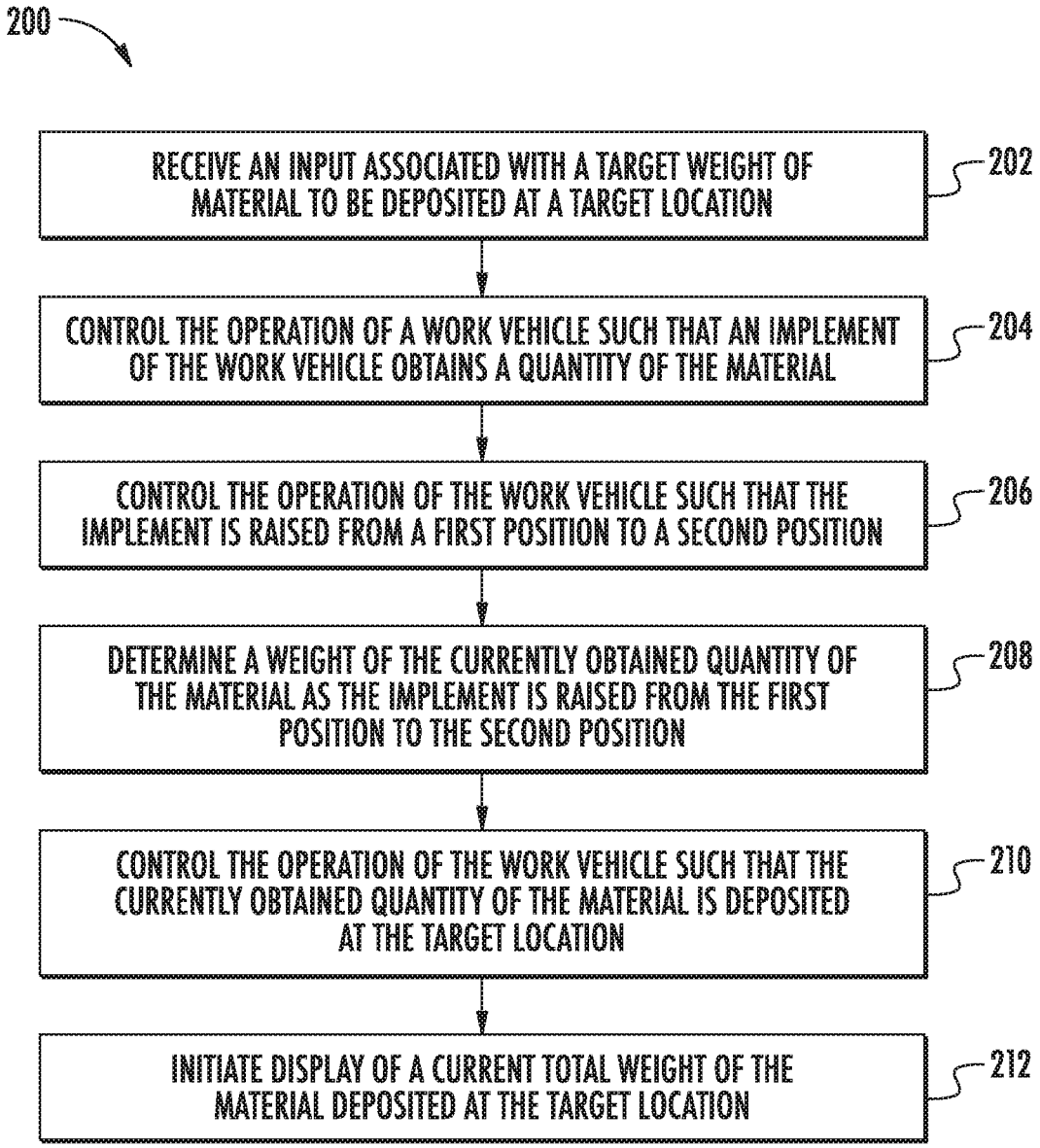
FIG. 3 illustrates a flow diagram of one embodiment of a method for depositing material at a target location with a work vehicle in accordance with aspects of the present subject matter.

Referring now to FIG. 3, a flow diagram of one embodiment of a method 200 for depositing material at a target location with a work vehicle is illustrated in accordance with aspects of the present subject matter. In general, the method 200 will be described herein with reference to the system 100 described above with reference to FIG. 2. However, it should be appreciated by those of ordinary skill in the art that the disclosed method 200 may be implemented within any other system having any other suitable system configuration. In addition, although FIG. 3 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 3, at (202), the method 200 may include receiving, with one or more computing devices, an input associated with a target weight of material to be deposited at a target location. Specifically, in several embodiments, the controller 102 may be configured to receive an input (e.g., via the input device(s) 134 of the user interface 133) associated with a target weight of a material (e.g., sand, gravel, dirt, and/or the like) to be deposited at a target location, such as within a container of a truck or a railroad car.

Additionally, at (204), the method 200 may include controlling, with the one or more computing devices, the operation of a work vehicle such that an implement of the vehicle obtains a quantity of the material. Specifically, in several embodiments, the controller 102 may be configured to control the operation of one or more components (e.g., the engine 104, the transmission 108, the pump 116, and/or the valve(s) 118, 120) of the work vehicle 10 such that the implement 22 is driven into a pile/source of the material and obtains a quantity (e.g., a bucket load) of the material.

Moreover, as shown in FIG. 3, at (206), the method 200 may include controlling, with the one or more computing devices, the operation of the work vehicle such that the implement is raised from a first position to a second position. Specifically, in several embodiments, the controller 102 may be configured to control the operation of one or more components (e.g., the pump(s) 116, and/or the valve(s) 118, 120) of the work vehicle 10 such that the implement 22 is raised from a first or lowered position relative to the driving surface to a second or raised position relative to the driving surface. In this respect, the quantity of material obtained by the implement 22 may be lifted relative to the driving surface.

Furthermore, at (208), the method 200 may include determining, with the one or more computing devices, the weight of the currently obtained quantity of the material as the implement is raised from the first position to the second position. Specifically, in several embodiments, the controller 102 may be configured to determine the weight of the currently obtained quantity of the material as the implement 22 is raised from the first position to the second position based on data received from the position sensors 38, 40; the inclination sensors 42; the pressure sensors 44, 46; and the temperature sensors 52.

In addition, as shown in FIG. 3, at (210), the method 200 may include controlling, with the one or more computing devices, the operation of the work vehicle such that the currently obtained quantity of the material is deposited at the target location. Specifically, in several embodiments, the controller 102 may be configured to control the operation of one or more components (e.g., the pump(s) 116 and/or the valve(s) 118, 120) of the work vehicle 10 such that the currently obtained quantity of the material is deposited at the target location.

Further, at (212), the method 200 may include initiating, with the one or more computing devices, display of a current total weight of the material deposited at the target location. Specifically, in several embodiments, the controller 102 may be configured to initiate display of one or more interface elements (e.g., a number(s) or a bar(s)) on the display device(s) 148 of the user interface 133. Such interface element(s) may, in turn, provide an indication of the current total weight of the material that has been deposited at the target location by the work vehicle 10. When the quantity of the material currently being deposited at the target location corresponds to the first quantity of the material deposited at the target location, the current total weight of the material may correspond to the determined weight of the currently obtained quantity of the material. However, as will be described below, when the quantity of the material being deposited at the target location corresponds to a second or subsequent quantity of the material, the controller 102 may be configured to add the determined weight of the currently obtained quantity of the material to the current total weight of the material deposited at the target location. Thereafter, the controller 102 may be configured to initiate an update to the displayed interface element(s) to reflect the updated current total weight of the material deposited at the target location.

Figure 4:
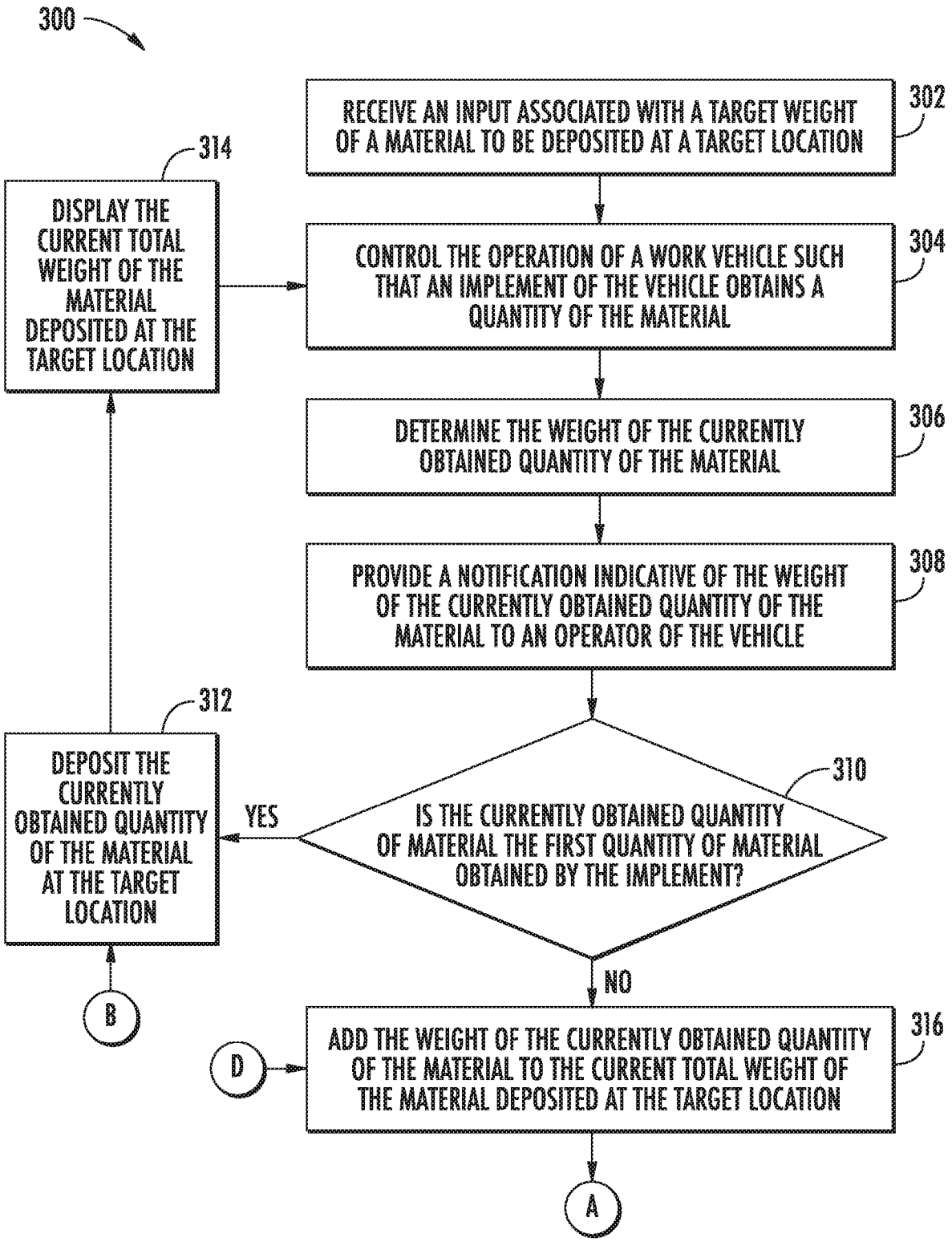
FIG. 4 illustrates a portion of a flow diagram representing a specific implementation of one embodiment of a method for depositing material at a target location with a work vehicle in accordance with aspects of the present subject matter.
Figure 5:
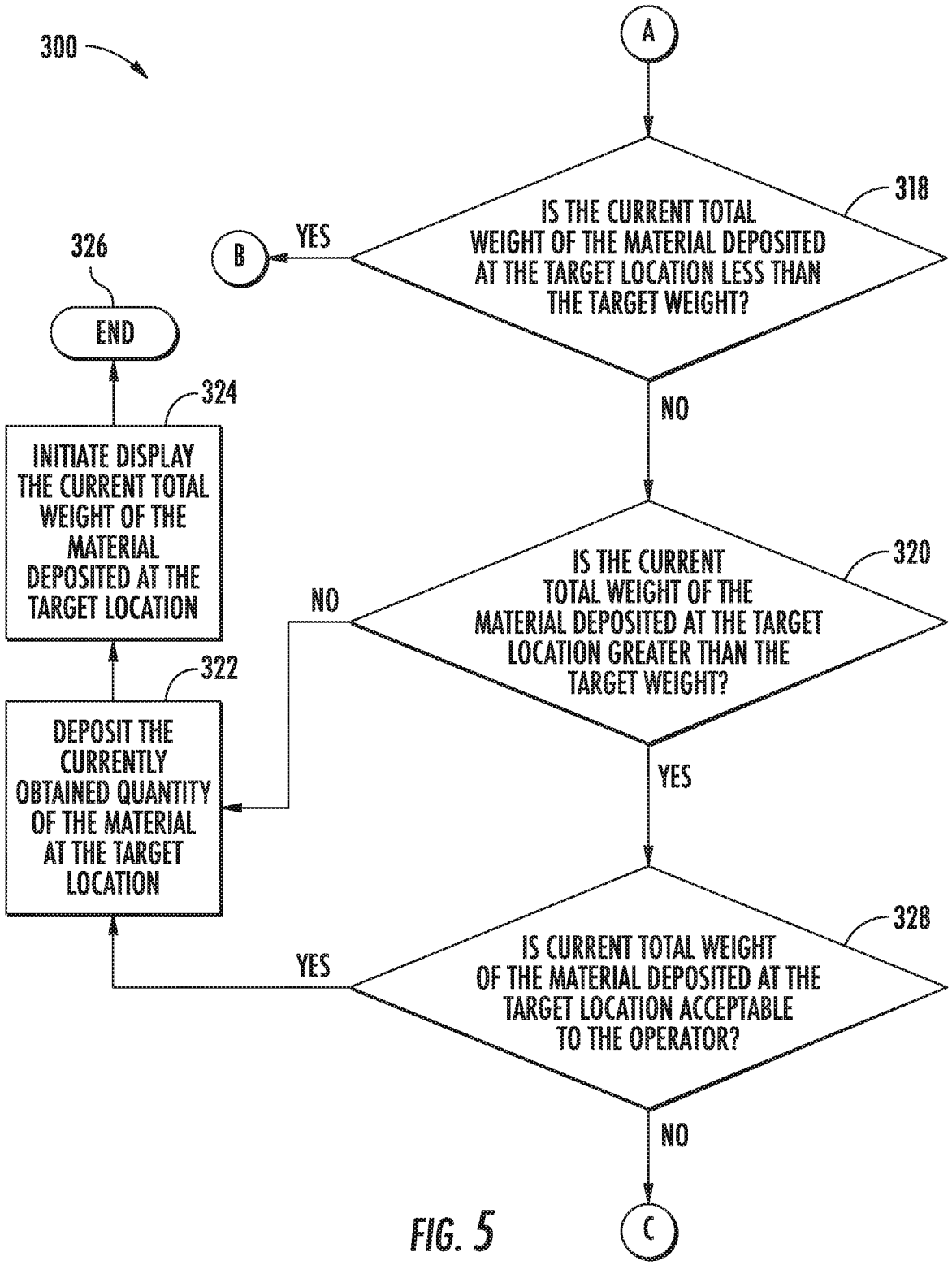
FIG. 5 illustrates another portion of the flow diagram shown in FIG. 4 in accordance with aspects of the present subject matter.
Figure 6:
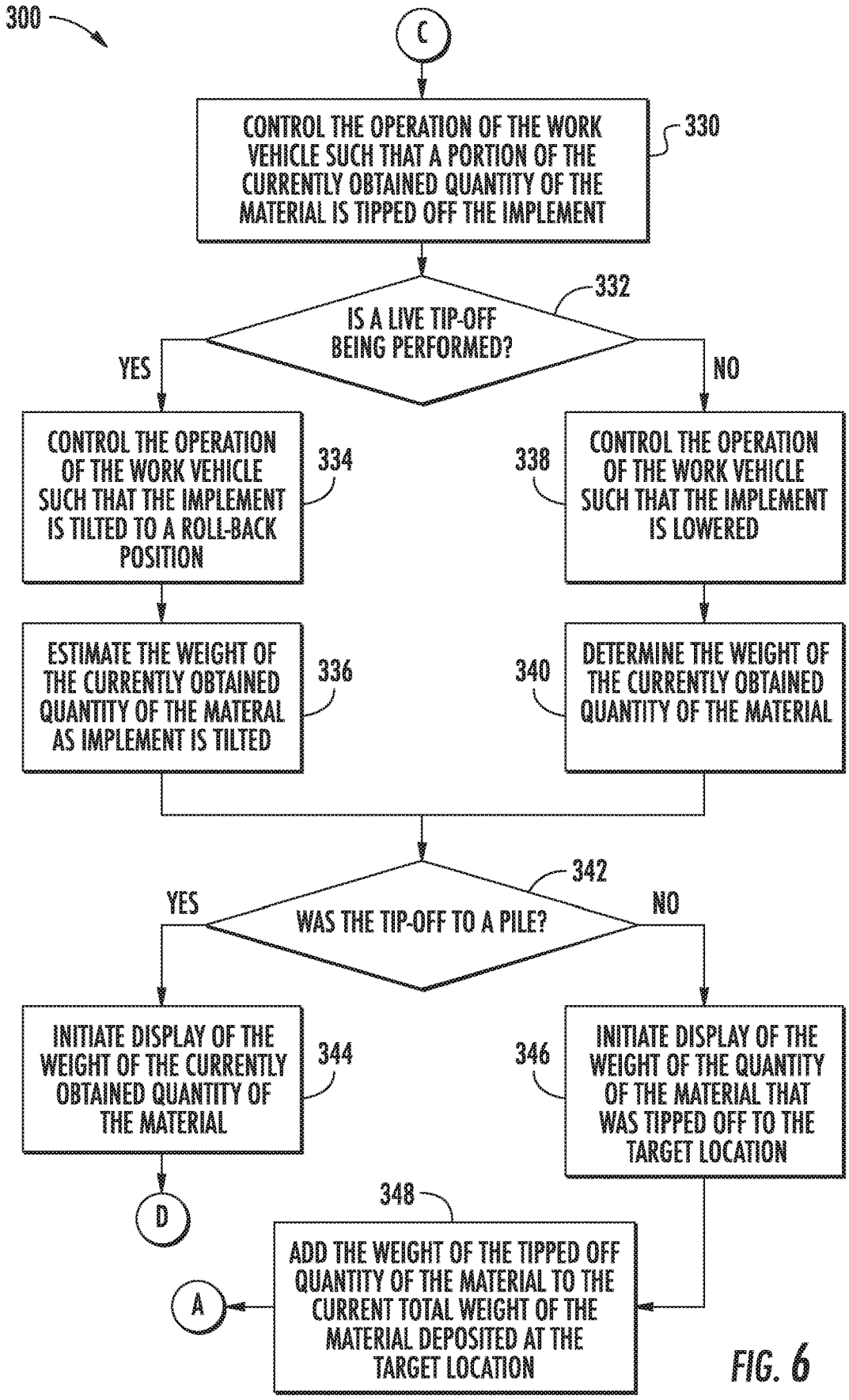
FIG. 6 illustrates a further portion of the flow diagram shown in FIGS. 4 and 5 in accordance with aspects of the present subject matter.

Referring now to FIGS. 4-6, a flow diagram of an example control algorithm 300 representing a specific implementation of one embodiment of a method for depositing material at a target location with a work vehicle is illustrated in accordance with aspects of the present subject matter. It should be appreciated by those of ordinary skill in the art that, although FIGS. 4-6 depicts steps performed in a particular order for purposes of illustration and discussion, the algorithms discussed herein are not limited to any particular order or arrangement. One skilled in the art, using the disclosures provided herein, will appreciate that various steps of the algorithms disclosed herein can be omitted, rearranged, combined, and/or adapted in various ways without deviating from the scope of the present disclosure.

As shown in FIG. 4, at (302), an input may be received by the controller 102 that is associated with the target weight of a material to be deposited at a target location. For instance, as indicated above, the operator of the work vehicle 10 may provide an operator input associated with a target weight of a material (e.g., sand, gravel, dirt, and/or the like) to be deposited at a target location (e.g., within a container of a truck or a railroad car) via the input device(s) 134 of the user interface 133.

Additionally, at (304), the controller 102 may be configured to control the operation of a work vehicle such that an implement of the vehicle obtains a quantity of the material. For instance, in several embodiments, the operator may provide one or more inputs via the input device(s) 134 instructing the work vehicle 10 to obtain a quantity of the material. Based on the input(s) received from the input device(s) 134, the controller 102 may be configured to control the operation of one or more components of the work vehicle 10 (e.g., the engine 104, the transmission 108, the pump(s) 116, and/or the control valve(s) 118, 120) such that the implement 22 of the vehicle 10 is driven into a pile of the material to obtain a quantity of such material. Alternatively, the controller 102 may be configured to automatically control the operation the control the operation of the vehicle component(s) such that the implement 22 of the vehicle 10 is driven into a pile of the material to obtain a quantity of such material.

Moreover, at (306), the controller 102 may be configured to determine the weight of the currently obtained quantity of the material. Specifically, in several embodiments, after obtaining the quantity of the material, the controller 102 may be configured to control the operation of the boom control valve(s) 118 such that the implement 22 of the vehicle 10 is lifted from a first or lowered position to a second or raised position. In one embodiment, in such instances, the controller 102 may be configured to control the operation of the boom control valve(s) 118 based on operator input(s) provided to the input device(s) 134. Alternatively, in such instances, the controller 102 may be configured to automatically control the operation of the boom control valve(s) 118. As the implement 22 is being moved from the lowered position to the raised position, the controller 102 may be configured to determine the weight of the quantity of material present within the implement 22. For example, as described above, the controller 102 may be communicatively coupled to the sensors 38, 40, 42, 44, 46, 52, which are configured to monitor various operating parameters of the work vehicle 10. Thus, as the operation of the boom cylinders 32 is controlled by the boom control valve(s) 118 to lift the implement 22, the controller 102 may determine the weight of the currently obtained quantity of the material based on the sensor data received from the sensors 38, 40, 42, 44, 46, 52.

After determining the weight of the currently obtained quantity of the material, at (308), the controller 102 may be configured to provide a notification of the weight of the currently obtained quantity of the material to the operator of the vehicle. For example, in one embodiment, the controller 102 may be configured to transmit instructions to the display device(s) 148 of the user interface 133. The instructions may, in turn, instruct the display device(s) 148 to display one or more interface elements (e.g., a number(s) or a bar(s)) indicating the determined weight of the currently obtained quantity of the material to the operator.

Referring still to FIG. 4, at (310), the controller 102 may be configured to determine whether currently obtained quantity of the material is the first quantity of the material obtained for deposition at the target location. Specifically, the controller 102 may be configured to determine whether the quantity of the material currently obtained by the implement 22 is the first quantity of the material obtained to meet the inputted target weight of the material to be deposited at the target location (e.g., via an operator input received from the input device(s) 134).

When the currently obtained quantity of the material is the first quantity of the material obtained for deposition at the target location, at (312), the controller 102 may be configured to control the operation of the work vehicle 10 such that the currently obtained quantity of the material is deposited at the target location. For example, in several embodiments, the controller 102 may be configured to control the operation of the boom control valve(s) 118 and/or the tilt control valve(s) 120 such that the currently obtained quantity of the material is dumped from the implement 22 at the target location. In one embodiment, in such instances, the boom control valve(s) 118 and/or the tilt control valve(s) 120 may be controlled based on operator input(s) provided to the input device(s) 134. Alternatively, in such instances, the boom control valve(s) 118 and/or the tilt control valve(s) 120 may be automatically controlled by the controller 102.

After depositing the currently obtained quantity of the material at the target location, at (314), the controller 102 may be configured to initiate display of the current total weight of the material deposited at the target location. More specifically, when the currently obtained quantity of the material deposited at the target location corresponds to the first quantity of the material deposited at the target location, the current total weight of the material deposited at the target location is the determined weight of the currently obtained quantity of the material. For example, in one embodiment, the controller 102 may be configured to transmit instructions to the display device(s) 148 of the user interface 133. The instructions may, in turn, instruct the display device(s) 148 to display one or more interface elements (e.g., a number(s) or a bar(s)) indicating the current total weight of the material deposited at the target location. Thereafter, the controller 102 may be configured to control the operation of the vehicle 10 such that the implement 22 obtains a second or subsequent quantity of the material from the pile (e.g., return (304)).

However, when the currently obtained quantity of the material is not the first quantity of the material obtained for deposition at the target location, at (316), the controller 102 may be configured to add the weight of the currently obtained quantity of the material to the current total weight of the material deposited at the target location. For example, in several embodiments, when the currently obtained quantity of the material is a second or subsequent quantity of the material to be deposited at the target location, the controller 102 may be configured to add the determined weight of such quantity of the material to the previously determined current total weight of the material deposited at the target location to obtain an updated value of the current total weight of the material deposited at the target location.

Referring now to FIG. 5, at (318), the controller 102 may be configured to determine whether the current total weight of the material deposited at the target location is less than the target weight. Specifically, after adding the weight of the currently obtained quantity of the material to the current total weight of the material deposited at the target location, the controller 102 may be configured to compare the updated value of the current total weight of the material deposited at the target location to the target weight inputted by the operator. When the current total weight of the material deposited at the target location is less than the target weight, the controller 102 may be configured to control the operation of the vehicle 10 such that the currently obtained quantity of material is deposited at the target location (e.g., at (312)) and the current total weight of the material is displayed to the operator (e.g., at (314)).

When the current total weight of the material deposited at the target location is not less than the target weight, at (320), the controller 102 may be configured to determine when the current total weight of the material deposited at the target location is greater than the target weight. When the current total weight of the material deposited at the target location is not greater than the target weight, at (322), the controller 102 may be configured to control the operation of the work vehicle 10 such that the currently obtained quantity of the material is deposited at the target location, such as in the same manner as described above with respect to (312). Thereafter, at (324), the controller 102 may be configured to initiate display of the current total weight of the material deposited at the target location, such as in the same manner as described above with respect to (314). Upon completion of (324), the target weight of the material has been deposited at the target location and the example control algorithm 300 is completed at (326).

Referring still to FIG. 5, when the current total weight of the material deposited at the target location is greater than the target weight, at (328), the controller 102 may be configured to determine whether the current total weight of the material deposited at the target location is acceptable to the operator. For example, in such instances, the controller 102 may be configured to initiate display of a notification to the operator that the determined weight of the currently obtained quantity of material will cause the total weight of the material deposited at the target location to exceed the target weight. Thereafter, the operator may provide an input (e.g., via the input device(s) 134) indicating whether he/she finds the current total weight of the material deposited at the target location (which is greater than the target weight) to be acceptable. When the current total weight of the material deposited at the target location is acceptable to the operator, at (322), the controller 102 may be configured to control the operation of the work vehicle 10 such that the currently obtained quantity of the material is deposited at the target location. Thereafter, at (324), the controller 102 may be configured to initiate display of the current total weight of the material deposited at the target location.

Referring now to FIG. 6, when the current total weight of the material deposited at the target location is not acceptable to the operator, at (330), the controller 102 may be configured to control the operation of the work vehicle 10 such that a portion of the currently obtained quantity of the material is tipped off the implement 22. Specifically, in such instances, the controller 102 may be configured to control the operation of the tilt control valve(s) 120 such that the implement 22 is tilted to a partial dump position. Once the implement 22 is at the partial dump position, a portion of the currently obtained quantity of the material present within the implement 22 is tipped off or otherwise dumped out of the implement 22, thereby reducing the amount (and the weight) of the currently obtained quantity of the material.

Furthermore, at (332), the controller 102 may be configured to determine whether a live tip-off is being performed. In general, after the tip-off is performed at (330), the weight of the reduced quantity of the material present within the implement 22 may be determined. During a live tip-off, the weight of the currently obtained quantity of the material may be determined as the implement 22 is tilted from the partial dump position to the roll-back position. For example, in one embodiment, the controller 102 may be configured to determine whether a live tip-off is being performed based on an operator input provided via the input device(s) 134.

When a live tip-off is performed, at (334), the controller 102 may be configured to control the operation of the work vehicle 10 such that the implement 22 is tilted to the roll-back position. Specifically, in such instances, the controller 102 may be configured to control the operation of the tilt control valve(s) 120 such that the implement 22 is tilted from the partial dump position to the roll-back position. Moreover, at (336), the controller 102 may be configured to estimate the weight of the currently obtained quantity of the material as the implement 22 is tilted. For example, as described above, the controller 102 may be communicatively coupled to the sensors 38, 40, 42, 48, 50, 52, which are configured to monitor various operating parameters of the work vehicle 10. Thus, as the operation of the tilt cylinders 34 is controlled by the tilt control valve(s) 120 to move the implement 22 to the roll-back position, the controller 102 may estimate the weight of the currently obtained quantity of the material based on the sensor data received from the sensors 38, 40, 42, 48, 50, 52.

Conversely, when a live tip-off is not being performed, at (338), the controller 102 may be configured to control the operation of the work vehicle 10 such that the implement 22 is lowered. Specifically, in such instances, the controller 102 may be configured to control the operation of the boom control valve(s) 118 such that the implement 22 is moved from its current position to a lowered position relative to the driving surface. Thereafter, at (340), the controller 102 may be configured to estimate the weight of the currently obtained quantity of the material as the implement 22 is lifted across a range of position in the same manner as described above with respect to (306). Moreover, as indicated above, the weight determination at (340) may generally be more accurate than the weight estimation at (336). However, the weight determination at (340) may generally be more time consuming than the weight estimation at (336).

Referring still to FIG. 6, at (342), the controller 102 may be configured to determine whether the tip-off was to the pile/source of the material. More specifically, the material tipped-off of the implement 22 at (330) may be dumped back into the pile/source from which the material was obtained at (304) or dumped at the target location. For example, in several embodiments, the controller 102 may be configured to receive an input from the operator (e.g., via the input device(s) 134) indicating whether the tip-off was to the pile/source or to the target location. When the tip-off was to the pile/source, at (344), the controller 102 may configured to initiate display of the weight of the currently obtained quantity of the material (the reduced quantity of the material present within the implement 22 after the tip-off), such as in the same manner as at (308). Thereafter, the controller 102 may return to (316) at which the weight of the currently obtained quantity of the material is added to the current total weight of the material deposited at the target location.

Alternatively, at (346), when the tip-off was to the target location, the controller 102 may be configured to the controller 102 may configured to initiate display of the weight of the quantity of the material that was tipped off to the target location, such as in the same manner as at (308). In addition, at (348), the controller 102 may be configured to add the weight of the quantity of the material that was tipped off to the target location to the current total weight of the material deposited at the target location determined at (316). Thereafter, the controller 102 may return to (318).

It is to be understood that the steps of the method/algorithm 200/300 are performed by the controller 102 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the controller 102 described herein, such as the method/algorithm 200/300, is implemented in software code or instructions which are tangibly stored on a tangible computer readable medium. The controller 102 loads the software code or instructions via a direct interface with the computer readable medium or via a wired and/or wireless network. Upon loading and executing such software code or instructions by the controller 102, the controller 102 may perform any of the functionality of the controller 102 described herein, including any steps of the method/algorithm 200/300 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. A method for depositing material at a target location with a work vehicle, the method comprising:

receiving, with one or more computing devices, an input associated with a target weight of the material to be deposited at the target location;

controlling, with the one or more computing devices, an operation of the work vehicle such that an implement of the work vehicle obtains a quantity of the material;

controlling, with the one or more computing devices, the operation of the work vehicle such that the implement is raised from a first position to a second position;

determining, with the one or more computing devices, a weight of the currently obtained quantity of the material as the implement is raised from the first position to the second position;

controlling, with the one or more computing devices, the operation of the work vehicle such that the currently obtained quantity of the material is deposited at the target location;

initiating, with the one or more computing devices, display of a current total weight of the material deposited at the target location;

determining, with the one or more computing devices, when the currently obtained quantity of the material corresponds to a first quantity of the material to be deposited at the target location, wherein, when the currently obtained quantity of the material corresponds to the first quantity of the material, the current total weight of the material deposited at the target location corresponds to the weight of the currently obtained quantity of the material;

when the currently obtained quantity of the material does not correspond to the first quantity of the material, adding, with the one or more computing devices, the determined weight of the currently obtained quantity of the material to the current total weight of the material deposited at the target location; and determining, with the one or more computing devices, whether the current total weight of the material deposited at the target location is greater than the target weight.

2. The method of claim 1, further comprising:

initiating, with the one or more computing devices, display of the determined weight of the currently obtained quantity of the material.

3. The method of claim 1, further comprising:

when the current total weight of the material deposited at the target location is greater than the target weight, determining, with the one or more computing devices, whether the current total weight of the material loaded at the target location is acceptable to an operator of the work vehicle; and when the current total weight of the material loaded at the target location is acceptable to the operator, controlling, with the one or more computing devices, the operation of the work vehicle such that the currently obtained quantity of the material is deposited at the target location.

4. The method of claim 3, further comprising:

when the current total weight of the material loaded at the target location is not acceptable to the operator, controlling, with the one or more computing devices, the operation of the work vehicle such that a portion of the currently obtained quantity of the material is tipped off the implement.

5. The method of claim 4, further comprising:

after the portion of the currently obtained quantity of the material is tipped off the implement, controlling, with the one or more computing devices, the operation of the work vehicle such that the implement is tilted to a roll-back position;

estimating, with the one or more computing devices, the weight of the currently obtained quantity of the material as the implement is tilted;

determining, with the one or more computing devices, whether the portion of the currently obtained quantity of the material was tipped off to a pile;

when the portion of the currently obtained quantity of the material was tipped off to the pile, initiating display of the weight of the currently obtained quantity of the material;

when the portion of the currently obtained quantity of the material was not tipped off to the pile, initiating display of the weight of the portion of the currently obtained quantity of the material that was tipped off.

6. The method of claim 4, further comprising:

after the portion of the currently obtained quantity of the material is tipped off the implement, controlling, with the one or more computing devices, the operation of the work vehicle such that the implement is lowered;

controlling, with the one or more computing device, the operation of the work vehicle such that the implement is raised across a range of positions;

determining, with the one or more computing devices, the weight of the currently obtained quantity of the material as the implement is raised from the first position to the second position;

determining, with the one or more computing devices, whether the portion of the currently obtained quantity of the material was tipped off to a pile;

when the portion of the currently obtained quantity of the material was tipped off to the pile, initiating display of the weight of the currently obtained quantity of the material;

when the portion of the currently obtained quantity of the material was not tipped off to the pile, initiating display of the weight of the portion of the currently obtained quantity of the material was tipped off.

7. A method for depositing material at a target location with a work vehicle, the method comprising:

receiving, with one or more computing devices, an input associated with a target weight of the material to be deposited at the target location;

controlling, with the one or more computing devices, an operation of the work vehicle such that an implement of the work vehicle obtains a quantity of the material;

controlling, with the one or more computing devices, the operation of the work vehicle such that the implement is raised from a first position to a second position;

determining, with the one or more computing devices, a weight of the currently obtained quantity of the material as the implement is raised from the first position to the second position;

controlling, with the one or more computing devices, the operation of the work vehicle such that the currently obtained quantity of the material is deposited at the target location;

initiating, with the one or more computing devices, display of a current total weight of the material deposited at the target location;

determining, with the one or more computing devices, when the currently obtained quantity of the material corresponds to a first quantity of the material to be deposited at the target location, wherein, when the currently obtained quantity of the material corresponds to the first quantity of the material, the current total weight of the material deposited at the target location corresponds to the weight of the currently obtained quantity of the material;

when the currently obtained quantity of the material does not correspond to the first quantity of the material, adding, with the one or more computing devices, the determined weight of the currently obtained quantity of the material to the current total weight of the material deposited at the target location;

determining, with the one or more computing devices, whether the current total weight of the material deposited at the target location is less than the target weight; and when the current total weight of the material deposited at the target location is less than the target weight, controlling, with the one or more computing devices, the operation of the work vehicle such that the currently obtained quantity of the material is deposited at the target location.

8. A system for depositing material at the target location with a work vehicle, the system comprising:

a lift assembly including a boom and an implement coupled to the boom;

a display device; and a controller communicatively coupled to the display device, the controller configured to control an operation of the work vehicle, the controller including a processor and associated memory, the memory storing instructions that, when implemented by the processor, configure the controller to:

receive an input associated with a target weight of the material to be loaded at the target location;

control the operation of the work vehicle such that the implement obtains a quantity of the material;

control the operation of the work vehicle such that the implement is raised from a first position to a second position;

determine a weight of the currently obtained quantity of the material as the implement is raised from the first position to the second position;

control the operation of the work vehicle such that the currently obtained quantity of the material is deposited at the target location;

initiate display of a current total weight of the material deposited at the target location on the display device;

determine when the currently obtained quantity of the material corresponds to a first quantity of the material to be deposited at the target location, wherein, when the currently obtained quantity of the material corresponds to the first quantity of the material, the current total weight of the material deposited at the target location corresponds to the weight of the currently obtained quantity of the material;

add the determined weight of the currently obtained quantity of the material to the current total weight of the material deposited at the target location when the currently obtained quantity of the material does not correspond to the first quantity of the material;

determine whether the current total weight of the material deposited at the target location is less than the target weight; and control the operation of the work vehicle such that the currently obtained quantity of the material is deposited at the target location when the current total weight of the material deposited at the target location is less than the target weight.

9. The system of claim 8, wherein the controller is further configured to initiate display of a determined weight of the currently obtained quantity of the material on the display device.

10. The system of claim of 8, wherein the controller is further configured to determine whether the current total weight of the material deposited at the target location is greater than the target weight.

11. The system of claim 10, wherein the controller is further configured to:

determine whether the current total weight of the material loaded at the target location is acceptable to an operator of the work vehicle when the current total weight of the material deposited at the target location is greater than the target weight; and control the operation of the work vehicle such that the currently obtained quantity of the material is deposited at the target location when the current total weight of the material loaded at the target location is acceptable to the operator.

12. The system of claim 11, wherein the controller is further configured to:

control the operation of the work vehicle such that a portion of the currently obtained quantity of the material is tipped off the implement when the current total weight of the material loaded at the target location is not acceptable to the operator.

13. The system of claim 12, wherein the controller is further configured to:

control the operation of the work vehicle such that the implement is tilted to a roll-back position after the portion of the currently obtained quantity of the material is tipped off the implement;

estimate the weight of the currently obtained quantity of the material as the implement is tilted;

determine whether the portion of the currently obtained quantity of the material was tipped off to a pile;

initiate display of the weight of the currently obtained quantity of the material on the display device when the portion of the currently obtained quantity of the material was tipped off to the pile; and initiate display of the weight of the portion of the currently obtained quantity of the material that was tipped off on the display device when the portion of the currently obtained quantity of the material was not tipped off to the pile.

14. The system of claim 12, wherein the controller is further configured to:

control the operation of the work vehicle such that the implement lowered after the portion of the currently obtained quantity of the material is tipped off the implement;

control the operation of the work vehicle such that the implement is raised across a range of positions;

determine the weight of the currently obtained quantity of the material as the implement is raised from the first position to the second position;

determine whether the portion of the currently obtained quantity of the material was tipped off to a pile;

initiate display of the weight of the currently obtained quantity of the material on the display device when the portion of the currently obtained quantity of the material was tipped off to the pile;

initiate display of the weight of the portion of the currently obtained quantity of the material that was tipped off on the display device when the portion of the currently obtained quantity of the material was not tipped off to the pile.

* * * * *